US005359696A

United States Patent [19]

Gerson et al.

[11] Patent Number: 5,359,696

[45] Date of Patent: Oct. 25, 1994

[54] DIGITAL SPEECH CODER HAVING IMPROVED SUB-SAMPLE RESOLUTION LONG-TERM PREDICTOR

[75] Inventors: Ira A. Gerson, Hoffman Estates; Mark A. Jasiuk, Chicago, both of Ill.

[73] Assignee: Motorola Inc., Schaumburg, Ill.

[21] Appl. No.: 214,998

[22] Filed: Mar. 21, 1994

Related U.S. Application Data

[63] Continuation of Ser. No. 966,680, Oct. 26, 1992, abandoned, which is a continuation of Ser. No. 668,384, Mar. 13, 1991, abandoned, which is a continuation of Ser. No. 402,206, Sep. 1, 1989, abandoned, which is a continuation-in-part of Ser. No. 212,455, Jun. 28, 1988, abandoned.

[51] Int. Cl.[5] ..... G10L 9/18

[52] U.S. Cl. ..... 395/2.32; 395/2.74

[58] Field of Search ..... 395/2.2, 2.3, 2.31, 395/2.32, 2.74; 381/29–40; 364/724.01, 724.16, 724.17, 723

[56] References Cited

U.S. PATENT DOCUMENTS

| | | | |
|---|---|---|---|
| 3,997,773 | 12/1976 | Van Essen et al. | 364/723 |
| 4,020,332 | 4/1977 | Crochiere et al. | 364/723 |
| 4,080,660 | 3/1978 | Constant | 364/715.01 |
| 4,569,030 | 2/1986 | Butterweck et al. | 364/724.17 |
| 4,573,135 | 2/1986 | Dietrich | 364/724.17 |
| 4,797,926 | 1/1989 | Bronson et al. | 381/38 |
| 4,811,396 | 3/1989 | Yatsuzuka | 381/30 |
| 4,817,157 | 3/1989 | Gerson | 381/40 |
| 4,896,361 | 1/1990 | Gerson | 381/40 |
| 4,908,867 | 3/1990 | Silverman | 381/38 |
| 4,910,781 | 3/1990 | Ketchum et al. | 381/36 |
| 4,918,729 | 4/1990 | Kudoh | 381/36 |

OTHER PUBLICATIONS

Schafer et al., "A Digital Signal Processing Approach to Interpolation", Proceedings of the IEEE, vol. 61, No. 6, Jun. 1973, pp. 692–702.

Bellanger et al., "Interpolation, Extrapolation, and Reduction of Computation Speed in digital Filters", IEEE Transactions on ASSP, vol. ASSP-32, No. 4, Aug. 1974, pp. 231–235.

*Primary Examiner*—David D. Knepper

*Attorney, Agent, or Firm*—Kirk W. Dailey

[57] ABSTRACT

A digital speech coder includes a long-term filter (124) having an improved sub-sample resolution long-term predictor (FIG. 5) which allows for subsample resolution for the lag parameter L. A frame of N samples of input speech vector s(n) is applied to an adder (510). The output of the adder (510) produces the output vector b(n) for the long term filter (124). The output vector b(n) is fed back to a delayed vector generator block (530) of the long-term predictor. The nominal long-term predictor lag parameter L is also input to the delayed vector generator block (530). The long-term predictor lag parameter L can take on non-integer values, which may be multiples of one half, one third, one fourth or any other rational fraction. The delayed vector generator (530) includes a memory which holds past samples of b(n). In addition, interpolated samples of b(n) are also calculated by the delayed vector generator (530) and stored in its memory, at least one interpolated sample being calculated and stored between each past sample of b(n). The delayed vector generator (530) provides output vector q(n) to the long-term multiplier block (520), which scales the long-term predictor response by the long-term predictor coefficient $\beta$. The scaled output $\beta q(n)$ is then applied to the adder (510) to complete the feedback loop of the recursive filter (124).

16 Claims, 6 Drawing Sheets

400

DIGITAL SPEECH CODER HAVING IMPROVED SUB-SAMPLE RESOLUTION LONG-TERM PREDICTOR

This is a continuation of application Ser. No. 07/966,680, filed Oct. 26, 1992 and now abandoned, which is a continuation of application Ser. No. 07/668,384, filed Mar. 13, 1991 and now abandoned, which is a continuation of Ser. No. 07/402,206, filed Sep. 1, 1989 and now abandoned, which in turn is a continuation-in-part of application Ser. No. 07/212,455, filed Jun. 28, 1988 and now abandoned.

BACKGROUND OF THE INVENTION

The present invention generally relates to digital speech coding at low bit rates, and more particularly, is directed to an improved method for determining long-term predictor output responses for code-excited linear prediction speech coders.

Code-excited linear prediction (CELP) is a speech coding technique which has the potential of producing high quality synthesized speech at low bit rates, i.e., 4.8 to 9.6 kilobits-per-second (kbps). This class of speech coding, also known as vector-excited linear prediction or stochastic coding, will most likely be used in numerous speech communications and speech synthesis applications. CELP may prove to be particularly applicable to digital speech encryption and digital radiotelephone communication systems wherein speech quality, data rate, size, and cost are significant issues.

The term "code-excited" or "vector-excited" is derived from the fact that the excitation sequence for the speech coder is vector quantized, i.e., a single codeword is used to represent a sequence, or vector, of excitation samples. In this way, data rates of less than one bit per sample are possible for coding the excitation sequence. The stored excitation code vectors generally consist of independent random white Gaussian sequences. One code vector from the codebook is chosen to represent each block of N excitation samples. Each stored code vector is represented by a codeword, i.e., the address of the code vector memory location. It is this codeword that is subsequently sent over a communications channel to the speech synthesizer to reconstruct the speech frame at the receiver. See M. R. Schroeder and B. S. Atal, "Code-Excited Linear Prediction (CELP): High-Quality Speech at Very Low Bit Rates", Proceedings of the IEEE International Conference on Acoustics, Speech and Signal Processing (ICASSP), Vol. 3, pp. 937–40, March 1985, for a more detailed explanation of CELP.

In a CELP speech coder, the excitation code vector from the codebook is applied to two time-varying linear filters which model the characteristics of the input speech signal. The first filter includes a long-term predictor in its feedback loop, which has a long delay, i.e., 2 to 15 milliseconds, used to introduce the pitch periodicity of voiced speech. The second filter includes a short-term predictor in its feedback loop, which has a short delay, i.e., less than 2 msec, used to introduce a spectral envelope or format structure. For each frame of speech, the speech coder applies each individual code vector to the filters to generate a reconstructed speech signal, and compares the original input speech signal to the reconstructed signal to create an error signal. The error signal is then weighted by passing it through a weighting filter having a response based on human auditory perception. The optimum excitation signal is determined by selecting the code vector which produces the weighted error signal having the minimum energy for the current frame. The codeword for the optimum code vector is then transmitted over a communications channel.

In a CELP speech synthesizer, the codeword received from the channel is used to address the codebook of excitation vectors. The single code vector is then multiplied by a gain factor, and filtered by the long-term and short-term filters to obtain a reconstructed speech vector. The gain factor and the predictor parameters are also obtained from the channel. It has been found that a better quality synthesized signal can be generated if the actual parameter used by the synthesizer are used in the analysis stage, thus minimizing the quantization errors. Hence, the use of these synthesis parameters in the CELP speech analysis stage to produce higher quality speech is referred to as analysis-by-synthesis speech coding.

The short-term predictor attempts to predict the current output sample s(n) by a linear combination of the immediately preceding output samples s(n-i), according to the equation:

$$s(n)=\alpha_1 s(n-1)+\alpha_2 s(n-2)+\ldots+\alpha_p s(n-p)+e(n)$$

where p is the order of the short-term predictor, and e(n) is the prediction residual, i.e., that part of s(n) that cannot be represented by the weighted sum of p previous samples. The predictor order p typically ranges from 8 to 12, assuming an 8 kilohertz (kHz) sampling rate. The weights $\alpha_1$, $\alpha_2$, $\alpha_p$, in this equation are called the predictor coefficients. The short-term predictor coefficients are determined from the speech signal using conventional linear predictive coding (LPC) techniques. The output response of the short-term filter may be expressed in Z-transform notation as:

$$A(z)=\frac{1}{1-\sum_{i=1}^{p}\alpha_i z^{-i}}$$

Refer to the article entitled "Predictive Coding of Speech at Low Bit Rates", IEEE Trans. Commun., Vol. COM-30, pp. 600–14, April 1982, by B. S. Atal, for further discussion of the short-term filter parameters.

The long-term filter, on the other hand, must predict the next output sample from preceding samples that extend over a much longer time period. If only a single past sample is used in the predictor, then the predictor is a single-tap predictor. Typically, one to three taps are used. The output response for a long-term filter incorporating a single-tap, long-term predictor is given in z-transform notation as:.

$$B(z)=\frac{1}{1-\beta z^{-L}}$$

Note that this output response is a function of only the delay or lag L of the filter and the filter coefficient $\beta$. For voiced speech, the lag L would typically be the pitch period of the speech, or a multiple of it. At a sampling rate of 8 kHz, a suitable range for the lag L would be between 16 and 143, which corresponds to a pitch range between 500 Hz to 56 Hz, respectively.

The long-term predictor lag L and long-term predictor coefficient $\beta$ can be determined from either an open-loop or a closed loop configuration. Using the open-loop configuration, the lag L and coefficient $\beta$ are computed from the input signal (or its residual) directly. In the closed loop configuration, the lag-L, and the coefficient $\beta$ are computed at the frame rate from coded data representing the past output of the long-term filter and the input speech signal. In using the coded data, the long-term predictor lag determination is based on the actual long-term filter state that will exist at the synthesizer. Hence, the closed-loop configuration gives better performance than the open-loop method, since the pitch filter itself would be contributing to the optimization of the error signal. Moreover, a single-tap predictor works very well in the closed-loop configuration.

Using the closed-loop configuration, the long-term filter output response b(n) is determined from only past output samples from the long-term filter, and from the current input speech samples s(n) according to the equation:

$$b(n)=s(n)+\beta b(n-L)$$

This technique is straightforward for pitch lags L which are greater than the frame length N, i.e., when $L \leqq N$, since the term $b(n-L)$ will always represent a past sample for all sample numbers n, $0 \leqq n \leqq N-1$. Furthermore, in the case of $L>N$, the excitation gain factor $\gamma$ and the long-term predictor coefficient 62 can be simultaneously optimized for given values of lag L and codeword i. It has been found that this joint optimization technique yields a noticeable improvement in speech quality.

If, however, long-term predictor lags L of less than the frame length N must be accommodated, the closed-loop approach fails. This problem can readily occur in the case of high-pitched female speech. For example, a female voice corresponding to a pitch frequency of 250 Hz may require a long-term predictor lag L equal to 4 milliseconds (msec). A pitch of 250 Hz at an 8 kHz sampling rate corresponds to a long-term predictor lag L of 32 samples. It is not desirable, however, to employ frame length N of less than 4 msec, since the CELP excitation vector can be coded more efficiently when longer frame lengths are used. Accordingly, utilizing a frame length time of 7.5 msec at a sampling rate of 8 kHz, the frame length N would be equal to 60 samples. This means only 32 past samples would be available to predict the next 60 samples of the frame. hence, if the long-term predictor lag L is less than the frame length N, only L past samples of the required N samples are defined.

Several alternative approaches have been taken in the prior art to address the problem of pitch lags L being less than frame length N. In attempting to jointly optimize the long-term predictor lag L and coefficient $\beta$, the first approach would be to attempt to solve the equations directly, assuming no excitation signal to present. This approach is explained in the article entitled "Regular-Pulse Excitation - A Novel Approach to Effective and Efficient Multipulse Coding of Speech" by Kroon, et al., IEEE Transactions on Acoustics, Speech, and Signal Processing, Vol. ASSP- 34, No. 5, October 1986, pp. 1054–1063. However, in following this approach, a nonlinear equation in the single parameter $\beta$ must be solved. The solution of the quadratic or cubic in $\beta$ must be solved. The solution of the quadratic or cubic in $\beta$ is computationally impractical. Moreover, jointly optimizing the coefficient $\beta$ with the gain factor $\gamma$ is still not possible with this approach.

A second solution, that of limiting the long-term predictor delay L to be greater than the frame length N, is proposed by Singhal and Atal in the article "Improving Performance of MultiPulse LPC Coders at Low Bit Rates", Proceedings of the IEEE International Conference on Acoustics, Speech, and Signal Processing, Vol. 1, March 19–21, 1984, pp. 1.3.1–1.3.4. This artificial constraint on the pitch lag L often does not accurately represent the pitch information. Accordingly, using this approach, the voice quality is degraded for high-pitched speech.

A third solution is to reduce the size of the frame length N. With a shorter frame length, the long-term predictor lag L can always be determined from past samples. This approach, however, suffers from a severe bit rate penalty. With a shorter frame length, a greater number of long-term predictor parameters and excitation vectors must be coded, and accordingly, the bit rate of the channel must be greater to accommodate the extra coding.

A second problem exists for high pitch speakers. The sampling rate used in the coder places an upper limit on the performance of a single-tap pitch predictor. For example, if the pitch frequency is actually 485 Hz, the closest lag value would be 16 which corresponds to 500 Hz. This results in an error of 15 Hz for the fundamental pitch frequency which degrades voice quality. This error is multiplied for the harmonics of the pitch frequency causing further degradation.

A need, therefore, exists to provide an improved method for determining the long-term predictor lag L. The optimum solution must address both the problems of computational complexity and voice quality for the coding of high-pitched speech.

SUMMARY OF THE INVENTION

Accordingly, a general object of the present invention is to provide an improved digital speech coding technique that produces high quality speech at low bit rates.

A more specific object of the present invention is to provide a method to determine long-term predictor parameters using the dosed-loop approach.

Another object of the present invention is to provide an improved method for determining the output response of a long-term predictor in the case of when the long-term predictor lag parameter L is a non-integer number.

A further object of the present invention is to provide an improved CELP speech coder which permits joint optimization of the gain factor $\gamma$ and the long-term predictor coefficient $\beta$ during the codebook search for the optimum excitation code vector.

According to a novel aspect of the invention, the resolution of the parameter L is increased by allowing L to take on values which are not integers. This is achieved by the use of interpolating filters to provide interpolated samples of the long-term predictor state. In a dosed loop implementation, future samples of the long-term predictor state are not available to the interpolating filters. This problem is circumvented by pitch-synchronously extending the long-term predictor state into the future for use by the interpolation filter. When the actual excitation samples for the next frame become available, the long-term predictor state is updated to reflect the actual excitation samples (replacing those based on the pitch-synchronously extended samples). For example, the interpolation can be used to interpolate one sample between each existing sample thus doubling the resolution of L to half a sample. A higher interpolation factor could also be chosen, such as three or four, which would increase the resolution of L to a third or a fourth of a sample.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like-referenced numerals identify like elements, and in which:

DETAILED DESCRIPTION OF THE PREFERRED EMBODIMENT

Figure 1:
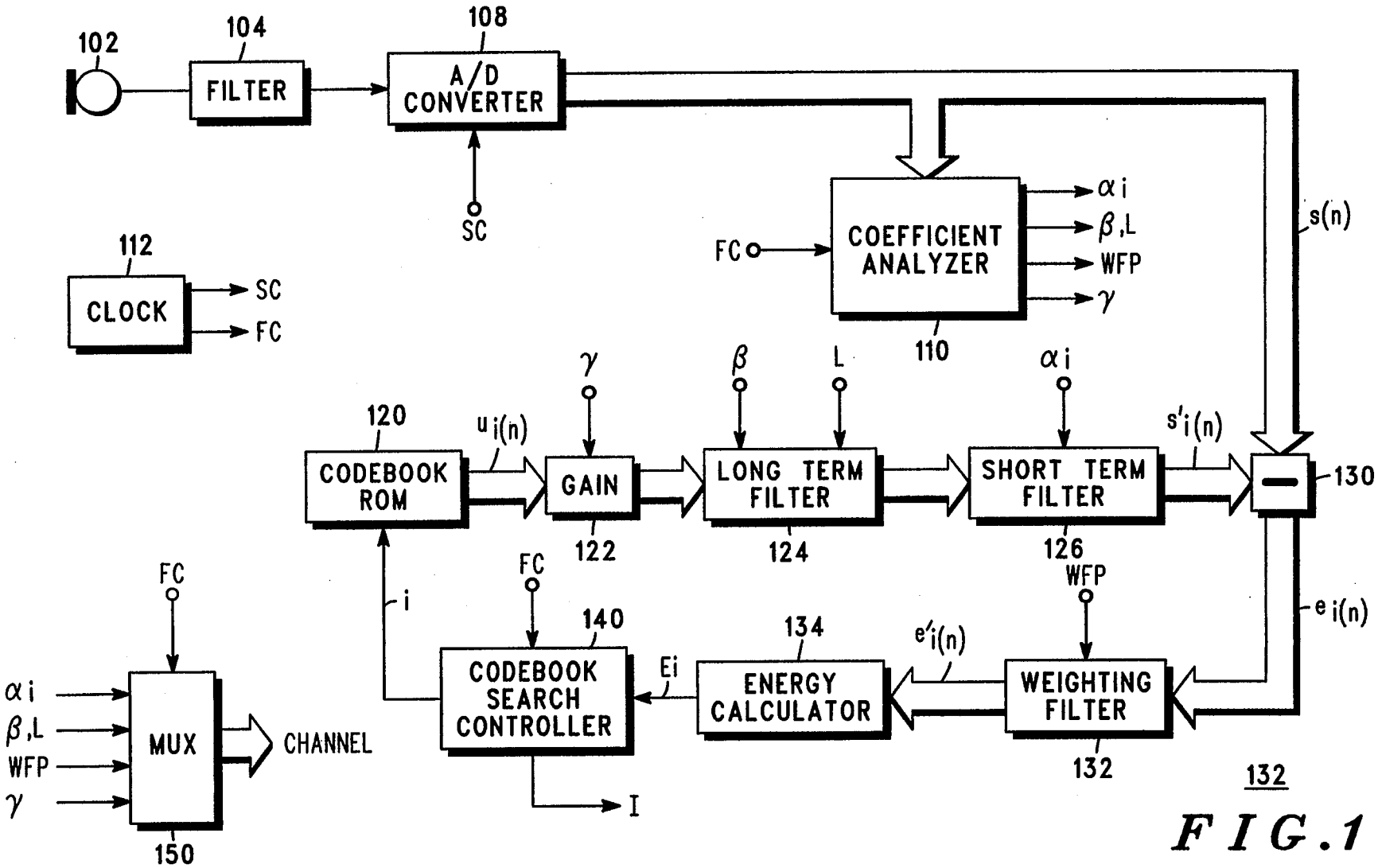
FIG. 1 is a general block diagram of a code-excited linear predictive speech coder, illustrating the location of a long-term filter for use with the present invention.

Referring now to FIG. 1, there is shown a general block diagram of code excited linear predictive speech coder 100 utilizing the long-term filter in accordance with the present invention. An acoustic input signal to be analyzed is applied to speech coder 100 at microphone 102. The input signal, typically a speech signal, is then applied to filter 104. Filter 104 generally will exhibit bandpass filter characteristics. However, if the speech bandwidth is already adequate, filter 104 may comprise a direct wire connection.

The analog speech signal from filter 104 is then converted into a sequence of N pulse samples, and the amplitude of each pulse sample is then represented by a digital code in analog-to-digital (A/D) converter 108, as known in the art. The sampling rate is determined by sample clock SC, which represents an 8.0 kHz rate in the preferred embodiment. The sample clock SC is generated along with the frame clock FC via clock 112.

The digital output of A/D 108, which may be represented as input speech vector s(n), is then applied to coefficient analyzer 110. This input speech vector s(n) is repetitively obtained in separate frames, i.e., blocks of time, the length of which is determined by the frame clock FC. In the preferred embodiment, input speech vector s(n), $0 \leqq n \leqq N-1$, represents a 7.5 msec frame containing $N=60$ samples, wherein each sample is represented by 12 to 16 bits of digital code. In this embodiment, for each block of speech, a set of linear predictive coding (LPC) parameters are produced by coefficient analyzer 110 in an open-loop configuration. The short-term predictor parameters $\alpha_i$, long-term predictor coefficient $\beta$, nominal long-term predictor lag parameter L, weighting filter parameters WFP, and excitation gain factor $\gamma$ along with the best excitation codeword I as described later) area applied to multiplexer 150 and sent over the channel for use by the speech synthesizer. Refer to the article entitled "Predictive Coding of Speech at Low Bit Rates," *IEEE Trans. Commun,*, Vol. COM-30, pp. 600–14, April 1982, by B. S. Atal, for representative methods of generating these parameters for this embodiment. The input speech vector s(n) is also applied to subtractor 130 the function of which will subsequently be described.

Codebook ROM 120 contains a set of M excitation vectors $u_i(n)$,. wherein $1 \leqq i \leqq M$, each comprised of N samples, wherein $0 \leqq n \leqq N-1$ Codebook ROM 420 is preferably implemented as described in U.S. Pat. No. 4,817,157, incorporated herein by reference. Codebook ROM 120 generates these pseudorandom excitation vectors in response to a particular one of a set of excitation codewords i. Each of the M excitation vectors are comprised of a series of random white Gaussian samples, although other types of excitation vectors may be used with the present invention. If the excitation signal were coded at a rate of 0.2 bits per sample for each of the 60 samples, then there would be 4096 codewords i corresponding to the possible excitation vectors.

For each individual excitation vector $u_i(n)$, a reconstructed speech vector $s'_i(n)$ is generated for comparison to the input speech vector s(n). Gain block 122 scales the excitation vector $u_i(n)$ by the excitation gain factor $\gamma$, which is constant for the frame. The excitation gain factor $\gamma$ may be pre-computed by coefficient analyzer 110 and used to analyze all excitation vectors as shown in FIG. 1, or may be optimized jointly with the search for the best excitation codeword I and generated by codebook search controller 140.

The scaled excitation signal $\gamma\, u_i(n)$ is then filtered by long-term filter 124 and short-term filter 126 to generate the reconstructed speech vector $s'_i(n)$. Filter 124 utilizes the long-term predictor parameters $\beta$ and L to introduce voice periodicity, and filter 126 utilizes the short-term predictor parameters $\alpha_i$ to introduce the spectral envelope, as described above. Long-term filter 124 will be described in detail in the following figures. Note that blocks 124 and 126 are actually recursive filters which contain the long-term predictor and short-term predictor in their respective feedback paths.

The reconstructed speech vector $s'_i(n)$ for the i-th excitation code vector is compared to the same block of the input speech vector s(n) by subtracting these two signals in subtractor 130. The difference vector $e_i(n)$ represents the difference between the original and the reconstructed blocks of speech. The difference vector is perceptually weighted by weighting filter 132, utilizing the weighting filter parameters WFP generated by coefficient analyzer 110. Refer to the preceding reference for a representative weighting filter transfer function. Perceptual weighting accentuates those frequencies where the error is perceptually more important to the human ear, and attenuates other frequencies.

Energy calculator 134 computes the energy of the weighted difference vector $e'_i(n)$, and applies this error signal $E_i$ to codebook search controller 140. The search controller compares the i-th error signal for the present excitation vector $u_i(n)$ against previous error signals to determine the excitation vector producing the minimum error. The code of the i-th excitation vector having a minimum error is then output over the channel as the best excitation code I. In the alternative, search controller 140 may determine a particular codeword which provides an error signal having some predetermined criteria, such as meeting a predefined error threshold.

FIG. 1 illustrates one embodiment of the invention for a code-excited linear predictive speech coder. In this embodiment, the long-term filter parameters L and $\beta$ are determined in an open-loop configuration by coefficient analyzer 110. Alternatively, the long-term filter parameters can be determined in a closed-loop configuration as described in the aforementioned Singhal and Atal reference. Generally, performance of the speech coder is improved using long-term filter parameters determined in the closed-loop configuration. The novel structure of the long-term predictor according to the present invention greatly facilitates the use of the closed-loop determination of these parameters for lags L less than the frame length N.

Figure 2C:
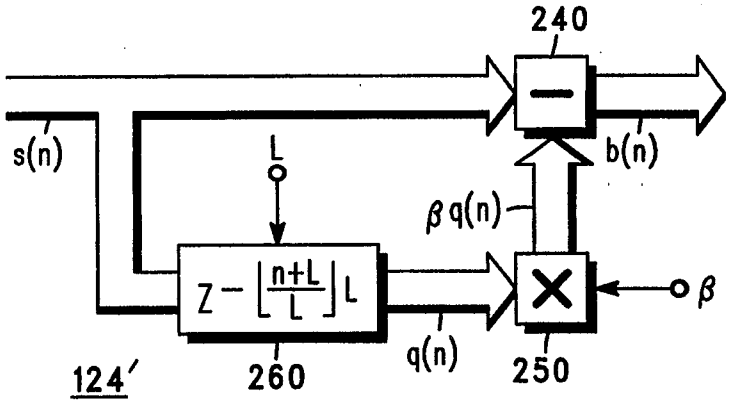
FIG. 2C is a detailed block diagram of another embodiment of the long-term filter of FIG. 1, illustrating the long-term predictor, response where filter lag L is an integer.
Figure 2B:
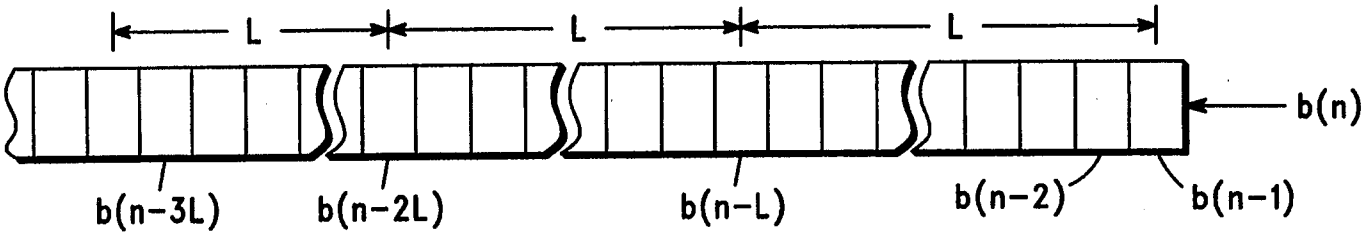
FIG. 2B is a simplified diagram of a shift register which can be used to illustrate the operation of the long-term predictor in FIG. 2A.
Figure 2A:
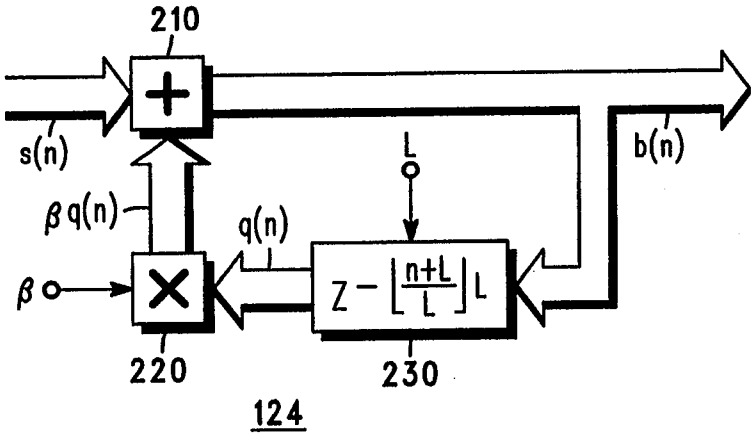
FIG. 2A is a detailed block diagram of an embodiment of the long-term filter of FIG. 1, illustrating the long-term predictor response where filter lag L is an integer.

FIG. 2A illustrates an embodiment of long-term filter 124 of FIG. 1, where L is constrained to be an integer. Although FIG. 1 shows the scaled excitation vector $\gamma$ $u_i(n)$ from gain block 122 as being input to long-term filter 124, a representative input speech vector s(n) has been used in FIG. 2A for purposes of explanation. hence, a frame of N samples of input speech vector s(n) is applied to adder 210. The output of adder 210 produces the output vector b(n) for the long-term filter 124. The output vector b(n) is fed back to delay block 230 of the long-term predictor. The nominal long-term predictor lag parameter L is also input to delay block 230. The long-term predictor delay block provides output vector q(n) to long-term predictor multiplier block 220, which scales the long-term predictor response by the long-term predictor coefficient $\beta$. The scaled output $\beta q(n)$ is then applied to adder 210 to complete the feedback loop if the recursive filter.

The output response $H_n(z)$ of long-term filter 124 is defined in Z-transform notation as:

$$H_n(z) = \frac{1}{1 - \beta z^{-\ (n+L)/L\ \ L)}}$$

wherein n represents a sample number of a frame containing N samples, $0 \leqq n \leqq N-1$, wherein $\beta$ represents a filter coefficient, wherein L represents the nominal lag or delay of the long-term predictor, and wherein [(n+L)/L] represents the closest integer less than or equal to (n+L)/L. The long-term predictor delay [(n+L)/L] L varies as a function of the sample number n. Thus, according to the present invention, the actual long-term predictor delay becomes kL, wherein L is the basic or nominal long-term predictor lag, and wherein k is an integer chosen from the set {1, 2, 3, 4, . . . . . } as a function of the sample number n. Accordingly, the long-term filter output response b(n) is a function of the nominal long-term predictor lag parameter L and the filter state FS which exists at the beginning of the frame. This statement holds true for all values of L—even for the problematic case of when the pitch lag L is less than the frame length N.

The function of the long-term predictor delay block 230 is to store the current input samples in order to predict future samples. FIG. 2B represents a simplified diagram of a shift register, which may be helpful in understanding the operation of long-term predictor delay block 230 of FIG. 2A. For sample number l, such that n=l, the current output sample b(n) is applied to the input of the shift register, which is shown on the right on FIG. 2B. For the next sample n=l+1, the previous sample b(n) is shifted left into the shift register. This sample now becomes the first past sample b(n−1). For the next sample n=l+2, another sample of b(n) is shifted into the register, and the original sample is again shifted left to become the second past sample b(n−2). After L samples have been shifted in, the original sample has been shifted left L number of times such that it may be represented as b(n−L).

As mentioned above, the lag L would typically be the pitch period of voiced speech or a multiple of it. If the lag L is as least as long as the frame length N, a sufficient number of past samples have been shifted in and stored to predict the next frame of speech. Even in the extreme case of where L=N, and where n=N−1, b(n−L) will be b(−1), which is indeed a past sample. Hence, the sample b(n−L) would be output from the shift register as the output sample q(n).

If however, the long-term predictor lag parameter L is shorter than the frame length N, then an insufficient number of samples would have been shifted into the shift register by the beginning of the next frame. Using the above example a 250 Hz pitch period, the pitch lag L would be equal to 32. Thus, where L=32 and N=60, and where n=N−1=59, b(n−L) would normally be b(27), which represents a future sample with respect to the beginning of the frame of 60 samples. In other words, not enough past samples have been stored to provide a complete long-term predictor response. The complete long-term predictor response is needed at the beginning of the frame such that closed-loop analysis of the predictor parameters can be performed. According to the invention in that case, the same stored samples b(n−L), $0 \leqq n \leqq L$, are repeated such that the output response of the long-term predictor is always a function of samples which have been input into the long-term predictor delay block prior to the start of the current frame. In terms of FIG. 2B, the shift register has thus been extended to store another kL samples, which represent modifying the structure of the long-term predictor delay block 230. Hence, as the shift register fills with new samples b(n), k must be chosen such that b(n−kL) represents a sample which existed in the shift register prior to the start of the frame. Using the previous example of L=32 and N=60, output sample q(32) would be a repeat of sample q(0), which is b(0−L)=b(32−2L) or b(−32).

Hence, the output response q(n) of the long-term predictor delay block 230 would correspond to:

$$q(n)=b(n-kL)$$

wherein $0 \leqq n \leqq N-1$, and wherein k is chosen as the samllest integer such that (n−kL) is negative. More specifically, if a frame of N samples of s(n) is input into long-term predictor filter 124, each sample number n is $j \leqq n \leqq N+j-1$ where j is the index for the first sample of a frame of N samples. Hence, the variable k would vary such that (n−kL) is always less than j. This ensures that the long-term predictor utilizes only samples available prior to the beginning of the frame to predict the output response.

Figure 3:
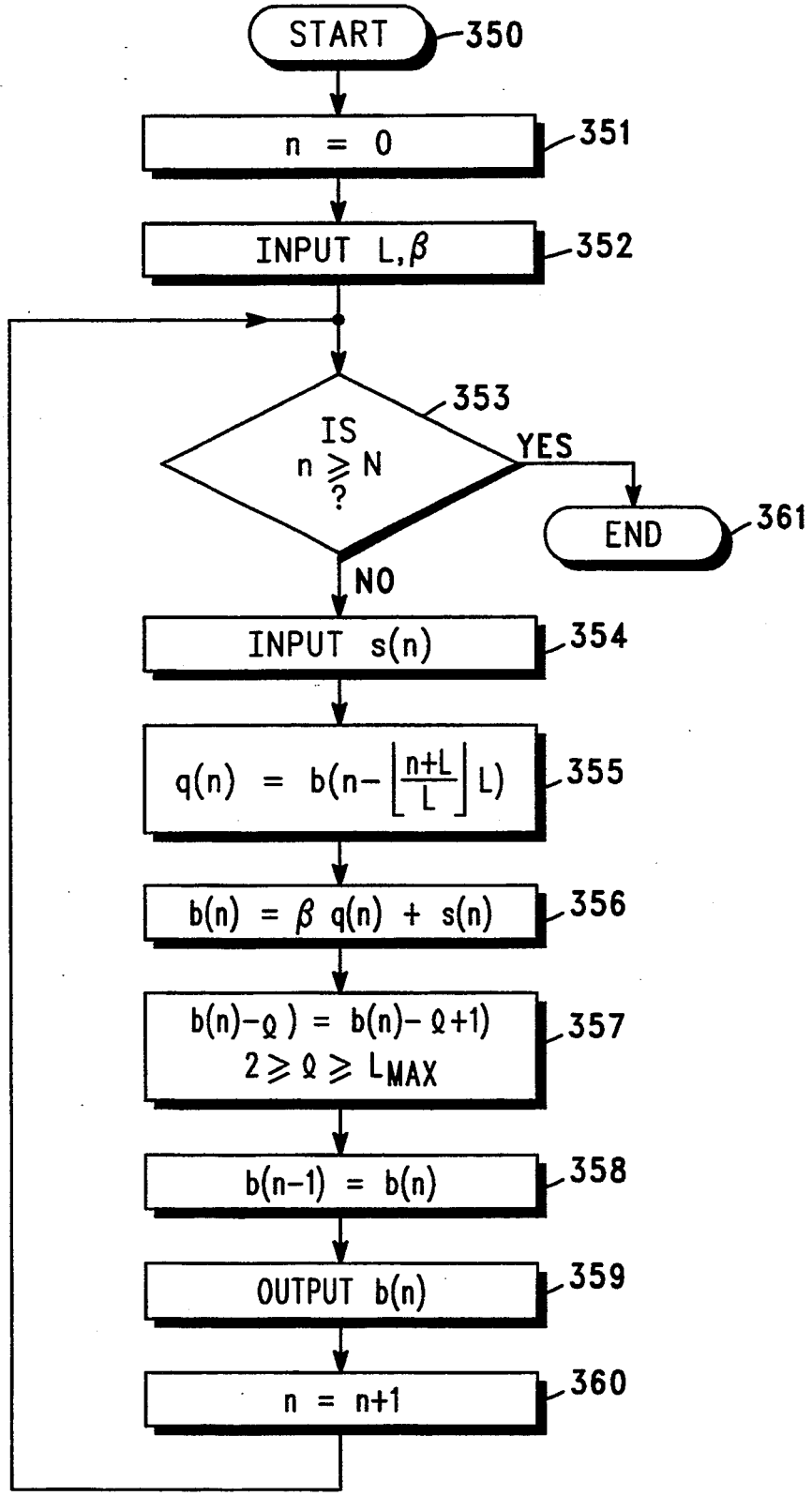
FIG. 3 is a derailed flowchart diagram illustrating the operations performed by the long-term filter of FIG. 2A.

The operation of long-term filter 124 of FIG. 2A will now be described in accordance with the flowchart of FIG. 3. Starting at step 350, the sample number n is initialized to zero at step 351. The nominal long-term predictor lag parameter L and the long-term predictor coefficient 13 are input from coefficient analyzer 110 in step 352. In step 353, the sample number n is tested to see if an entire frame has been output. If $n \geqq N$, operation ends at step 361. If all samples have not yet been computed, a signal sample s(n) is input in step 354. In step 355, the output response of long-term predictor delay block 230 is calculated according to the equation:

$$q(n)=b(n-[(n+L)/L]L)$$

wherein [(n+L)/L] represents the closest integer less than or equal to (n+L)/L. For example, if n=56 and L=32, then [(n+L)/L]L) becomes [(56+,32/32]L, which is [(2.75)]L or 2L. In step 356, the output response b(n) of the long-ter filter is computed according to the equation:

$$b(n)=\beta q(n)+s(n)$$

This represents the function of multiplier 220 and adder 210. In step 357, the sample in the shift register is shifted left one position, for all register locations between b(n−2) and $b(n-L_{MAX})$, where $L_{MAX}$ represents the maximum long-term predictor lag that can be assigned. In the preferred embodiment, $L_{MAX}$ would be equal to 143. In step 358, the output sample b(n) is input into the first location b(n−1) of the shift register. Step 359 outputs the filtered sample b(n). The sample number n is then incremented in step 360, and then tested in step 353. When all N samples have been computed, the process ends at step 361.

FIG. 2C is an alternative embodiment of a long-term filter incorporating the present invention. Filter 124' is the feedforward inverse version of the recursive filter configuration of FIG. 2A. Input vector s(n) is applied to both subtractor 240 and long-term predictor delay block 260. Delayed vector q(n) is output to multiplier 250, which scales the vector by the long-term predictor coefficient $\beta$. The output response $H_n(z)$ of digital filter 124' is given in z-transform notation as:

$$H_z(a)=1-\beta z-[(n+L)/L]L)$$

wherein n represents the sample number of a frame containing N samples, $0 \leqq n \leqq N-1$, wherein $\beta$ represents the long-term filter coefficient, wherein L represents the nominal lag or delay of the long-term predictor, and wherein [(n+L)/L] represents the closest integer less than or equal to (n+L)/L. The output signal b(n) of filter 124' may also be defined in terms of the input signal s(n) as:

$$b(n)=s(n)-[s(n-[(n+L)/L]L)$$

for $0 \leqq n \leqq N-1$. As can be appreciated by those skilled in the art, the structure of the long-term predictor has again been modified so as to repeatedly output the same stored samples of the long-term predictor in the case of when the long-term predictor lag L is less than the frame length N.

Figure 5:
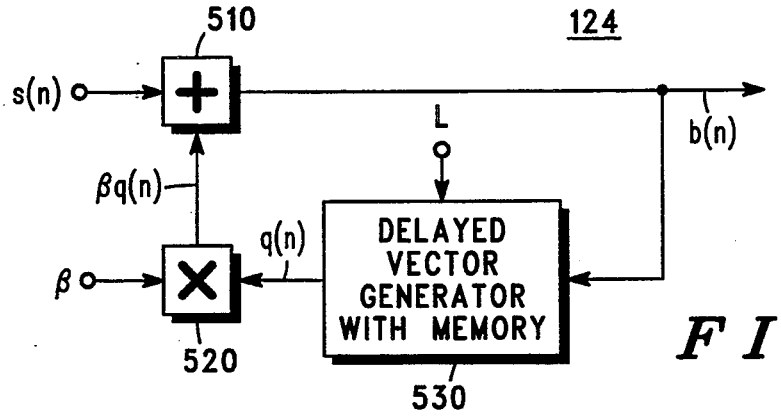
FIG. 5 is a detailed block diagram of the long-term filter of FIG. 1, illustrating the sub-sample resolution long-term predictor response in accordance with the present invention.

Referring next to FIG. 5, there is illustrated the preferred embodiment of the long-term filter 124 of FIG. 1 which allows for subsample resolution for the lag parameter L. A frame of N samples of input speech vector s(n) is applied to adder 510, The output of adder 510 produces the output vector b(n) for the long term filter 124. The output vector b(n) is fed back to delayed vector generator block 530 of the long-term predictor. The nominal long-term predictor lag parameter L is also input to delayed vector generator block 530. The long-term predictor lag parameter L can take on non-integer rational number values. The preferred embodiment allows L to take on values which are a multiple of one half. Alternate implementations of the sub-sample resolution long-term predictor of the present invention could allow values which are multiples of one third or one fourth or any other rational fraction.

In the preferred embodiment, the delayed vector generator 530 includes a memory which holds past samples of b(n). In addition, interpolated samples of b(n) are also calculated by delayed vector generator 530 and stored in its memory. In the preferred embodiment, the state of the long-term predictor which is contained in delayed vector generator 530 has two samples for every stored sample of b(n). One sample is for b(n) and the other sample represents an interpolated sample between two consecutive b(n) samples. In this way, samples of b(n) can be obtained from delayed vector generator 530 which correspond to integer delays or multiples of half sample delays. The interpolation is done using interpolating finite impulse response filters as described in the book by R. Crochiere and L. Rabiner entitled *Multirate Digital Signal Processing,* published by Prentice Hall in 1983. The operation of vector delay generator 530 is described in further detail hereinbelow in conjunction with the flowcharts in FIG. 6A and 6B.

Delayed vector generator 530 provides output vector q(n) to long-term multiplier block 520, which scales the long-term predictor response by the long-term predictor coefficient $\beta$. The scaled output $\beta q(n)$ is then applied to adder 510 to complete the feedback loop of the recursive filter 124 in FIG. 5.

Figure 6A:
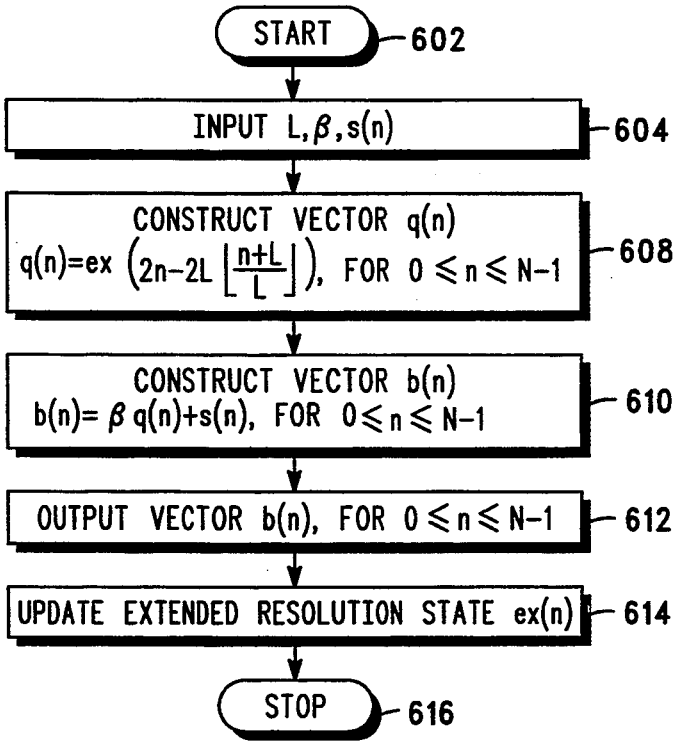
FIGS. 6A and 6B are detailed flowchart diagrams illustrating the operations performed by the long-term filter of FIG. 5.
Figure 6B:
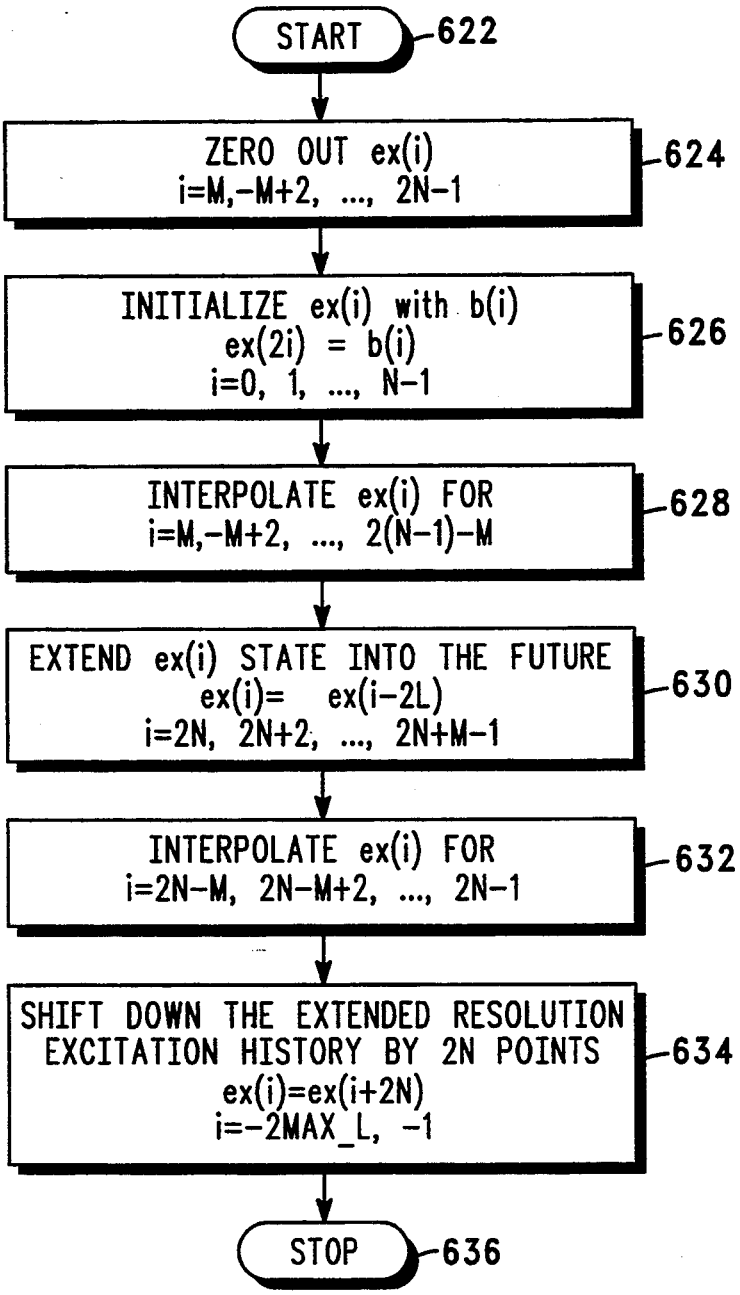

Referring to FIGS. 6A and 6B, there are illustrated detailed flowchart diagrams detailing the operations performed by the long-term filter of FIG. 5. According to the preferred embodiment of the present invention, the resolution of the long-term predictor memory is extended by mapping an N point sequence b(n), onto a 2N point vector ex(i). The negative indexed samples of ex(i) contain the extended resolution past values of long-term filter output b(n), or the extended resolution long term history. The mapping process doubles the temporal resolution of the long-term predictor memory, each time it is applied. Here for simplicity single stage mapping is described, although additional stages may be implemented in other embodiments of the present invention.

Entering at START step 602 in FIG. 6A, the flowchart proceeds to stop 604, where L, $\beta$ and s(n) are inputted. At step 608, vector q(n) is constructed according to the equation:

$$q(n)=ex(2n-2L[(n+L)/L])$$

for $0 \leqq n \leqq N-1$ wherein [(n+L)/L] represents the closest integer less than or equal to (n+L)/L and wherein L is the long term predictor lag. For voiced speech, long term predictor lag L may be the pitch period or a multiple of the pitch period. L may be an integer or a real number whose fractional part is 0.5 in the preferred embodiment. When the fractional part of L is 0.5, L has an effective resolution of half a sample.

In step 610, vector b(n) of the long-term filter is computed according to the equation:

$$b(n)=\beta q(n)+s(n)$$

$$\text{for } 0 \leqq n \leqq N-1$$

In step 612, vector b(n) of the long-term filter is outputted. In step 614, the extended resolution state ex(n) is updated to generate and store the interpolated values of b(n) in the memory of delayed vector generator 530. Step 614 is illustrated in more detail in FIG. 6B. Next, at step 616 the process has been completed and stops.

Entering at START step 622 in FIG. 6B, the flowchart proceeds to step 624, where the samples in ex(i) to be calculated in this subframe are zeroed out, ex(i)=0 for i=−M, −M+2, . . . , 2N−1, where M is chosen to be odd for an interpolating filter of order 2M+1. For example, if the order of the filter is 39, M is 19. Although M has been chosen to be odd for simplicity, M may also be even. At step 626, every other sample of ex(i) for i=0, 2, . . . , 2(N−1) is initialized with samples of b(n) according to the equation:

$$ex(2i)=b(i)$$

$$\text{for } i=0, 1, \ldots, N-1.$$

Thus ex(i) for i=0, 2, . . . , 2(N−1) now holds the output vector b(n) for the current frame mapped onto its even indices, while the odd indices of ex(i) for i=1, 3, . . . , 2(N−1)+1 are initialized with zeros.

At step 628, the interpolated samples of ex(i) initialized to zero are reconstructed through FIR interpolation, using a symmetric, zero-phase shift filter, assuming that the order of such FIR filter is 2M+1 as explained hereinabove. The FIR filter coefficients are a(j), where j=−M, −M+2, . . . , M−1, M and where a(j)=a(−j). Only even samples pointed to be the FIR filter taps are used in sample reconstruction, since odd samples have been set to zero. As a result, M+1 samples instead of 2M+1 samples are actually weighted and summed for each reconstructed sample. The FIR interpolation is performed according to the equation:

$$ex(i) = 2 \sum_{j=1}^{\frac{(M+1)}{2}} a_{2j-1}[ex(i-2j+1)+ex(i+2j-1)],$$

for i=−M, −+2, . . . , 2(n−1)−M−2,2(N−1)−M

Note that the first sample to be reconstructed is ex(−M), not ex(1) as one might expect. This is because interpolated samples at indices −M,−M+2, . . ,−1 were reconstructed at the previous frame using an estimate of the excitation in the current frame, since the actual excitation samples were then undefined. At the current frame those samples are known (we have b(n)), and thus the samples of ex(i), for i=−M,−M+2, . . ,−1 are now reconstructed again, with the filter taps pointing to the actual and not estimated values of b(n).

The largest value of i in the above equation, is 2(N&31 1)−M. This means that (M+1)/2 odd samples of ex(i), for i=2N−M,2N−M+2, . . . ,2(N−1)+1, still are to be reconstructed. However, for those values of index i, the upper taps of the interpolating filter point to the future samples of the exaltation which are as yet undefined. To calculate the values of ex(i) for those indices, the future state of ex(i) for i=2N,2N+2, . . . ,2N+M−1 is extended by evaluating at step 630:

$$ex(i)=\lambda ex(i-2L),$$

$$\text{for } i=2N, 2N+2, \ldots, 2N+M-1$$

The minimum value of 2L to be used in this scheme is 2M+1. This constraint may be lifted if we define:

$$ex(i)=\lambda ex(F(i-2L)),$$

$$\text{for } i=2N, 2N+2, \ldots, 2N+M-1;$$

where F(i−2L) for i−2L equal to odd numbers is given by:

$$F(i-2L)=\begin{cases} i-2L, & \text{for } i-2L \leqq 2(N-1)-M \\ i-2L-2L\ \dfrac{i-2(N-1)+M-2}{2L}, & \text{for } i-2L > 2(N-1)-M \end{cases}$$

and where F(i−2L) for i−2L equal to even numbers is given by:

$$F(i-2L)=\begin{cases} i-2L, & \text{for } i-2L \leqq 2(N-1) \\ i-2L-2L\ \dfrac{i-2(N-1)-2}{2L}, & \text{for } i-2L > 2(N-1) \end{cases}$$

The parameter λ, the history extension scaling factor, may be set equal to $\beta$, which is the pitch predictor coefficient, or set to unity.

At step 632, with the excitation history thus extended, the last (M+1)/2 zeroed samples of the current extended resolution frame are calculated using:

$$ex(i) = 2 \sum_{j=1}^{\frac{(M+1)}{2}} a_{2j-1}[ex(i-2j+1)+ex(i+2j-1)],$$

for i=2N−M,2−M+2, . . . , 2N−11 )+1

These samples will be recalculated at the next subframe, once the actual excitation samples for ex(i), i=2N,2N+2, . . . ,2N+M−1 become available.

Thus b(n), for n=0,N−1 has been mapped onto vector ex(i), i=0,2, . . . ,2(N−1). The missing zeroed samples have been reconstructed using an FIR interpolating filter. Note that the FIR interpolation is applied only to the missing samples. This ensures that no distortion is unnecessarily introduced into the known samples, which are stored at even indices of ex(i). An additional benefit of processing only the missing samples, is that computation associated with the interpolation is halved.

At step 634, finally the long term predictor history is updated by shifting down the contents of the extended resolution excitation vector ex(i) by 2N points:

$$ex(i)=ex(i+2N),$$

$$\text{for } i=-2Max_L,-1$$

where Max_L is the maximum long term predictor delay used. Next, at step 636 the process has been completed and stops.

Figure 4:
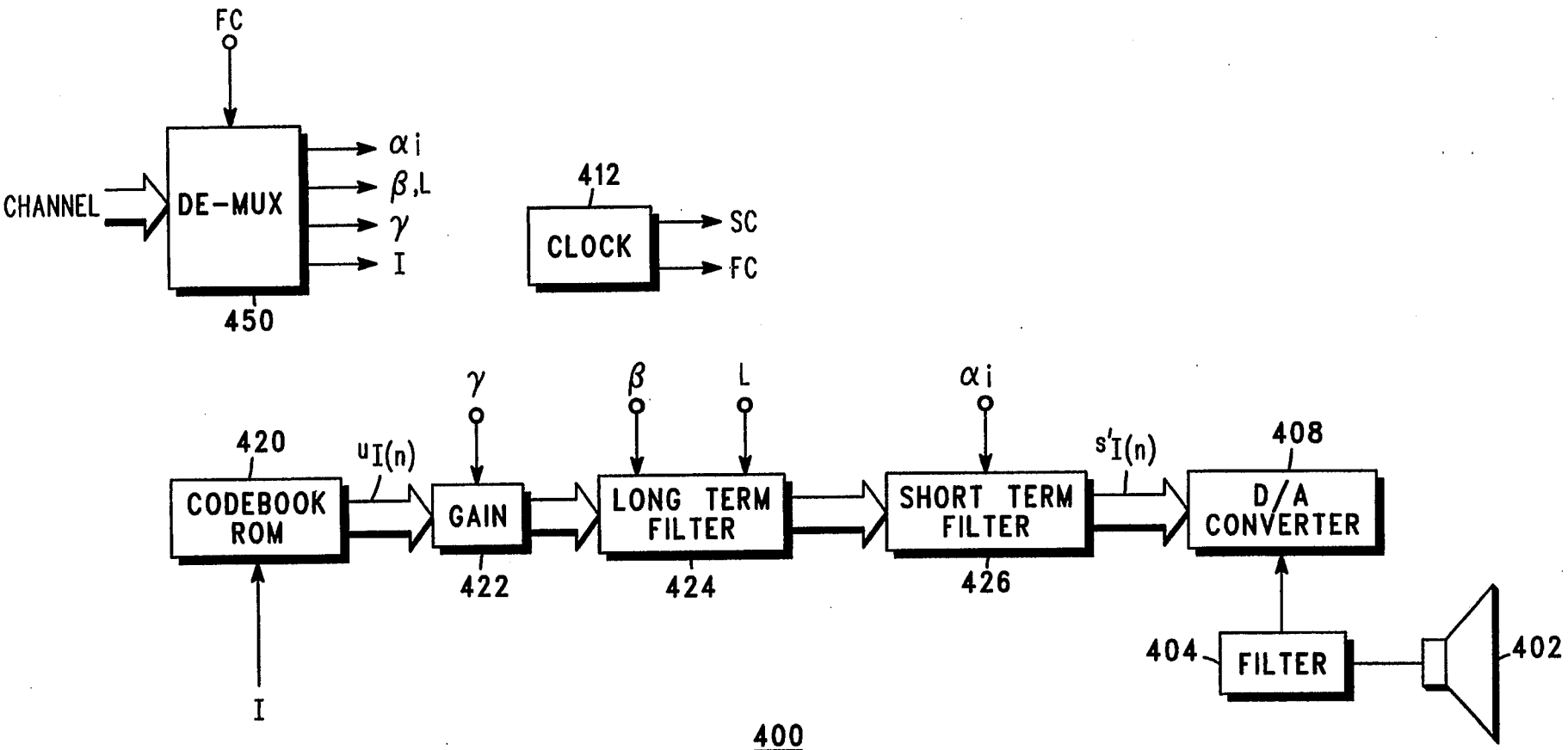
FIG. 4 is a general block diagram of a speech synthesizer for use in accordance with the present invention.

Referring now to FIG. 4, a speech synthesizer block diagram is illustrated using the long-term filter of the present invention. Synthesizer 400 obtains the short-term predictor parameters $\alpha_i$, long-term predictor parameters $\beta$ and L, excitation gain factor $\gamma$ and the codeword I received from the channel, via de-multiplexer 450. The codeword I is applied to codebook ROM 420 to address the codebook of excitation vectors. Codebook ROM 420 is preferably implemented as described in U.S. Pat. No. 4,817,157, incorporated herein by reference. The single excitation vector $u_I(n)$ is then multiplied by the gain factor $\gamma$ in block 422, filtered by long-term predictor filter 424 and short-term predictor filter 426 to obtain reconstructed speech vector $s'_I(n)$. This vector, which represents a frame of reconstructed speech, is then applied to analog-to-digital (A/D) convertor 408 to produce a reconstructed analog signal, which is then low pass filtered to reduce aliasing by filter 404, and applied to an output transducer such as speaker 402. Hence, the CELP synthesizer utilizes the same codebook, gain block, long-term filter, and short-term filter as the CELP analyzer of FIG. 1.

Figure 7:
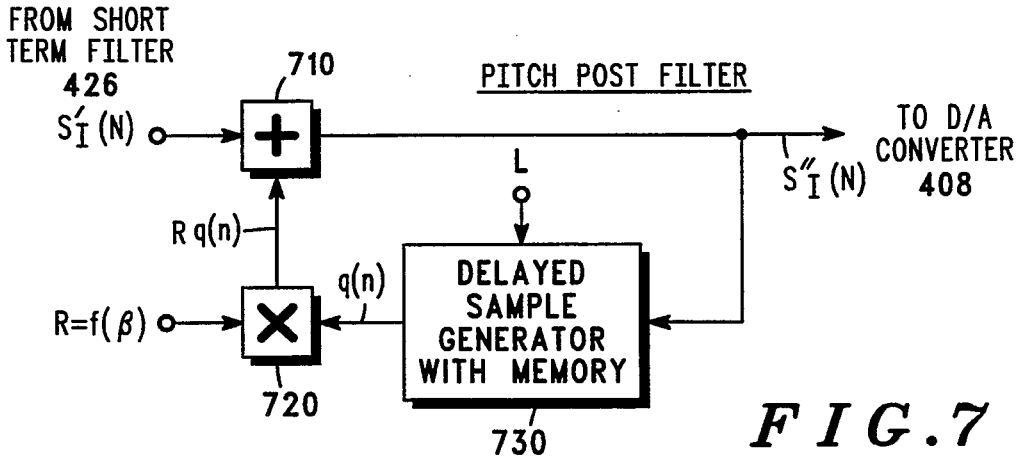
FIG. 7 is a detailed block diagram of a pitch post filter for intercoupling he short term filter and D/A converter of the speech synthesizer in FIG. 4.

FIG. 7 is a detailed block diagram of a pitch post filter for intercoupling the short term filter 426 and D/A converter 408 of the speech synthesizer in FIG. 4. A pitch post filter enhances the speech quality by removing noise introduced by the filters 424 and 426. A frame of N samples of reconstructed speech vector $s'_I(n)$ is applied to adder 710. The output of adder 710 produces the output vector $s''_I(n)$ for the pitch post filter. The output vector $s''_I(n)$ is fed back to delayed sample generator block 730 of the pitch post filter. The nominal long-term predictor lag parameter L is also input to delayed sample generator block 730. L may take on non-integer values for the present invention. If L is a non-integer, an interpolating FIR filter is used to generate the fractional sample delay needed. Delayed sample generator 730 provides output vector q(n) to multiplier block 720, which scales the pitch post filter response by coefficient R which is a function of the long-term predictor coefficient $\beta$. The scaled output Rq(n) is then applied to adder 710 to complete the feedback loop of the pitch post filter in FIG. 7.

In utilizing the long-term predictor response according to the present invention, the excitation gain factor $\gamma$ and the long-term predictor coefficient $\beta$ can be simultaneously optimized for all values of L in a closed-loop configuration. This joint optimization technique was heretofore impractical for values of $L < N$, since the joint optimization equations would become nonlinear in the single parameter $\beta$. The present invention modifies the structure of the long-term predictor to allow a linear joint optimization equation. In addition, the present invention allows the long-term predictor lag to have better resolution than one sample thereby enhancing its performance.

Moreover, the codebook search procedure has been further simplified, since the zero state response of the long-term filter becomes zero for lags less than the frame length. This additional feature permits those skilled in the art to remove the effect of the long-term filter from the codebook search procedure. Hence, a CELP speech coder has been shown which can provide higher quality speech for all pitch rates while retaining the advantages of practical implementation and low bit rate.

While specific embodiments of the present invention have been shown and described herein, further modifications and improvements may be made without departing from the invention in its broader aspects. For example, any type of speech coding (e.g., RELP, multipulse, RPE, LPC, etc.) may be used with the sub-sample resolution long-term predictor filtering technique described herein. Moreover, additional equivalent configurations of the sub-sample resolution long-term predictor structure may be made which perform the same computations as those illustrated above.

We claim:

1. A method of reconstructing speech comprising the steps of:

receiving from a communication channel a set of speech parameters including codeword I and a delay parameter L, where L may have a value in a predetermined range including integer and non-integer values related to a speech pitch period;

generating an excitation vector having a plurality of samples in response to the codeword I;

filtering the excitation vector based on at least the delay parameter L and stored filter state samples, the step of filtering comprising the steps of:

computing interpolated filter state samples from the stored filtered state samples using a non-integer L to determine the appropriate interpolation parameters, and combining the excitation vector with the interpolated filter state samples, thereby forming a filter output vector having a plurality of filter output samples; and processing the filter output vector to produce reconstructed speech.

2. A method of reconstructing speech in accordance with claim 1 wherein the step of filtering further comprises the step of combining, responsive to L being an integer, the excitation vector with the stored filter state samples, thereby forming filter state output samples.

3. A method of reconstructing speech in accordance with claim 1 wherein the step of filtering further comprises the step of updating the stored filter state samples using the filter output samples.

4. A method of reconstructing speech in accordance with claim 1 further comprising the steps of:

converting the reconstructed speech to an analog voice signal; and transducing the analog voice signal into a perceptible audio output, such that the speech pitch periods are more accurately predicted.

5. Apparatus for reconstructing speech comprising:

receiving circuitry for receiving from a communication channel a set of speech parameters including codeword I and a delay parameter L, where L may have a value in a predetermined range including integer and non-integer values related to a speech pitch period;

generating circuitry for generating an excitation vector having a plurality of samples in response to the codeword I;

filtering circuitry for filtering the excitation vector based on at least the delay parameter L and stored filter state samples, the filtering circuitry comprising:

computing circuitry for computing interpolated filter state samples from the stored filtered state samples using a non-integer L to determine the appropriate interpolation parameters, and combining circuitry for combining the excitation vector with the interpolated filter state samples, thereby forming a filter output vector having a plurality of filter output samples; and processing circuitry for processing the filter output vector to produce reconstructed speech.

6. Apparatus for reconstructing speech in accordance with claim 5 wherein the combining circuitry further comprises combining, responsive to L being an integer, the excitation vector with the stored filter state samples, thereby forming filter state output samples.

7. Apparatus for reconstructing speech in accordance with claim 5 wherein the filtering circuitry further comprising updating circuitry for updating the stored filter state samples using the filter output samples.

8. Apparatus for reconstructing speech in accordance with claim 5 further comprising:

converting circuitry for converting the reconstructed speech to an analog voice signal; and transducer circuitry for transducing the analog voice signal into a perceptible audio output, such that the speech pitch periods are more accurately predicted.

9. A method of reconstructing speech comprising the steps of:

receiving from a communication channel a set of speech parameters including codeword I and a delay parameter L, where L may have a value in a predetermined range including integer and non-integer value related to a speech pitch period;

generating an excitation vector having a plurality of samples in response to the codeword I;

filtering the excitation vector based on at least the delay parameter L, a set of stored filter state samples and at least one set of stored interpolated filter state samples, the step of filtering comprises the steps of:

choosing a chosen set of filter state samples from the group consisting of the set of stored filter state samples and the at least one set of stored interpolated filter state samples, the step of choosing using at least the delay parameter L, and combining the excitation vector with the chosen filter state samples, thereby forming a filter output vector having a plurality of filter output samples; and processing the filter output vector to produce reconstructed speech.

10. A method of reconstructing speech in accordance with claim 9 further comprising the steps of:

converting the reconstructed speech to an analog voice signal; and transducing the analog voice signal into a perceptible audio output, such that the speech pitch periods are more accurately predicted.

11. Apparatus for reconstructing speech comprising:

receiving circuitry for receiving from a communication channel a set of speech parameters including codeword I and a delay parameter L, where L may have a value in a predetermined range including integer and non-integer values related to a speech pitch period;

generating circuitry for generating an excitation vector having a plurality of samples in response to the codeword I;

filtering circuitry for filtering the excitation vector based on at least the delay parameter L, a set of stored filter state samples and at least one set of stored interpolated filter state samples, the filtering circuitry comprising:

choosing circuitry for choosing a chosen set of filter state samples from the group consisting of the set of stored filter state samples and the at least one set of stored interpolated filter state samples, the step of choosing using at least the delay parameter L, and combining circuitry for combining the excitation vector with the chosen filter state samples, thereby forming a filter output vector having a plurality of filter output samples; and processing circuitry for processing the filter output vector to produce reconstructed speech.

12. Apparatus for reconstructing speech in accordance with claim 11 further comprising:

converting circuitry for converting the reconstructed speech to an analog voice signal; and transducing circuitry for transducing the analog voice signal into a perceptible audio output, such that the speech pitch periods are more accurately predicted.

13. A method of encoding speech into sets of speech parameters for transmission on a communication channel, each set of speech parameters, the method comprising the steps of:

sampling a voice signal plurality of times to provide a plurality of samples forming a present speech vector;

generating a delay parameter L having a value in a predetermine range including integer and non-integer values related to a speech pitch period of the present speech vector;

searching excitation vectors to determine a codeword I that best matches the present speech vector, the step of searching comprising the steps of:

generating excitation vectors in response to corresponding codewords;

filtering each excitation vector comprising the steps of;

computing interpolated filter state samples from the stored filtered state samples using a non-integer L to determine the appropriate interpolation parameters, and combining the excitation vector with the interpolated filter state samples, thereby forming a filter output vector having a plurality of filter output samples;

processing the filter output vector to produce a reconstructed speech vector;

comparing the reconstructed speech vector to the present speech vector to determine the difference therebetween; and selecting the codeword I of the excitation vector for which the reconstructed speech vector differs the least from the present speech vector; and transmitting the selected codeword I and delay parameter L together with preselected speech parameters for the present speech vector on the communications channel, such that the speech pitch periods are more accurately predicted.

14. Apparatus for encoding speech into sets of speech parameters for transmission on a communication channel, each set of speech parameters, the apparatus comprising:

sampling circuitry for sampling a voice signal a plurality of times to provide a plurality of samples forming a present speech vector;

generating circuitry for generating a delay parameter L having a value in a predetermine range including integer and non-integer values related to a speech pitch period of the present speech vector;

searching circuitry for searching excitation vectors to determine a codeword I that best matches the present speech vector, the searching circuitry comprising:

generating circuitry for generating excitation vectors in response to corresponding codewords;

filtering circuitry for filtering each excitation vector, the filtering circuitry comprising:

computing circuitry for computing interpolated filter state samples from the stored filtered state samples using a non-integer L to determine the appropriate interpolation parameters, and combining circuitry for combining the excitation vector with the interpolated filter state samples, thereby forming a filter output vector having a plurality of filter output samples;

processing circuitry for processing the filter output vector to produces a reconstructed speech vector;

comparing circuitry for comparing the reconstructed speech vector to the present speech vector to determine the difference therebetween; and selecting circuitry for selecting the codeword I of the excitation vector for which the reconstructed speech vector differs the least from the present speech vector; and transmitting circuitry for transmitting the selected codeword I and delay parameter L together with pre-selected speech parameters for the present speech vector on the communications channel, such that the speech pitch periods are more accurately predicted.

15. A method of encoding speech into sets of speech parameters for transmission on a communication channel, each set of speech parameters, the method comprising the steps of:

sampling a voice signal a plurality of times to provide a plurality of samples forming a present speech vector;

generating a delay parameter L having a value in a predetermine range including integer and non-integer values relates to a speech pitch period of the present speech vector;

searching excitation vectors to determine a codeword I that best matches the present speech vector, the step of searching comprising the steps of:

generating excitation vectors in response to corresponding codewords;

filtering each excitation vector based on at least the delay parameter L, a set of stored filter state samples and at least one set of stored interpolated filter state samples, the step of filtering comprising:

choosing a chosen set of filter state samples from the group consisting of the set of stored filter state samples and the at least one set of stored interpolated filter state samples, the step of choosing using at least the delay parameter L, and combining the excitation vector with the chosen filter state samples, thereby forming a filter output vector having a plurality of filter output samples;

processing the filter output vector to produce a reconstructed speech vector;

comparing the reconstructed speech vector to the present speech vector to determine the difference therebetween; and selecting the codeword I of the excitation vector for which the reconstructed speech vector differs the least from the present speech vector; and transmitting the selected codeword I and delay parameter L together with preselected speech parameters for the present speech vector on the communications channel, such that the speech pitch periods are more accurately predicted.

16. Apparatus for encoding speech into sets of speech parameter for transmission on a communication channel, each set of speech parameters, the apparatus comprising:

sampling circuitry for sampling a voice signal a plurality of times to provide a plurality of samples forming a present speech vector;

generating circuitry for generating a delay parameter L having a value in a predetermine range including integer and non-integer values related to a speech pitch period of the present speech vector;

searching circuitry for searching excitation vectors to determine a codeword I that best matches the present speech vector, the searching circuitry comprising:

generating circuitry for generating excitation vectors in response to corresponding codewords;

filtering circuitry for filtering each excitation vector based on at least the delay parameter L, a set of stored filter state samples and at least one set of stored interpolated filter state samples, the filtering circuitry comprising:

choosing circuitry for choosing a chosen set of filter state samples from the group consisting of the set of stored filter state samples and the at least one set of stored interpolated filter state samples, the choosing circuitry using at least the delay parameter L, and combining circuitry for combining the excitation vector with the chosen filter state samples, thereby forming a filter output vector having a plurality of filter output samples;

processing circuitry for processing the filter output vector to produce a reconstructed speech vector;

comparing circuitry for comparing the reconstructed speech vector to the present speech vector to determine the difference therebetween; and selecting circuitry for selecting the codeword I of the excitation vector for which the reconstructed speech vector differs the least from the present speech vector; and transmitting circuitry for transmitting the selected codeword I and delay parameter L together with pre-selected speech parameters for the present speech vector on the communications channel, such that the speech pitch periods are more accurately predicted.

* * * * *